United States Patent [19]

Gaynor

[11] Patent Number: 4,713,019

[45] Date of Patent: Dec. 15, 1987

[54] SOCKETS FOR COMPACT FLUORESCENT LAMPS

[76] Inventor: Edwin Gaynor, 688 Hulls Farm Rd., Southport, Conn. 06490

[21] Appl. No.: 908,193

[22] Filed: Sep. 17, 1986

[51] Int. Cl.[4] ..... H01R 4/24

[52] U.S. Cl. ..... 439/232; 439/441

[58] Field of Search ..... 439/226–228, 439/232, 233, 353, 357, 358, 441

[56] References Cited

U.S. PATENT DOCUMENTS

| | | | |
|---|---|---|---|
| 3,093,433 | 6/1963 | Ege | 439/441 |
| 3,206,710 | 9/1965 | McLaughlin | 439/441 |
| 3,781,759 | 12/1973 | Shelly, Jr. | 439/232 |
| 4,596,433 | 6/1986 | Oesterheld et al. | 339/112 |

*Primary Examiner*—Joseph H. McGlynn

[57] ABSTRACT

A socket for fluorescent lamps includes in a side wall, at least one integral resilient flange having an inward facing hook shaped for establishing reversible locking engagement with a retaining hook on the lamp's base. At least two such inward facing resilient flange hooks are preferred. An access opening at the bottom of the socket is provided for molding each hook integral with the socket and for air circulation to the lamp's base. Lips on external walls are provided to protect the lamp pins from contact by foreign bodies when the lamp base is installed in the socket. A key slot on a socket wall for mating with a key protrusion on the lamp base assures that the desired specific wattage lamp is installed in the socket. Snap-in-lock flanges are alternatively provided for base, side and top mounting of the sockets. Flange mounting is also provided.

16 Claims, 31 Drawing Figures

FIG. 1
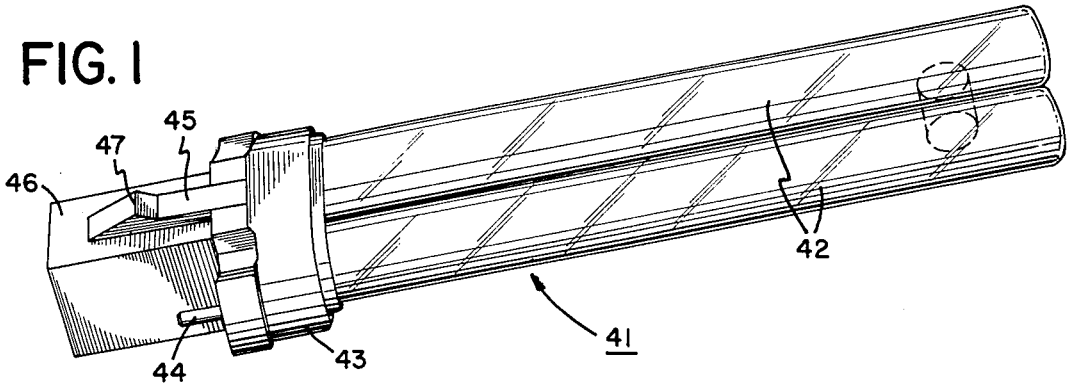
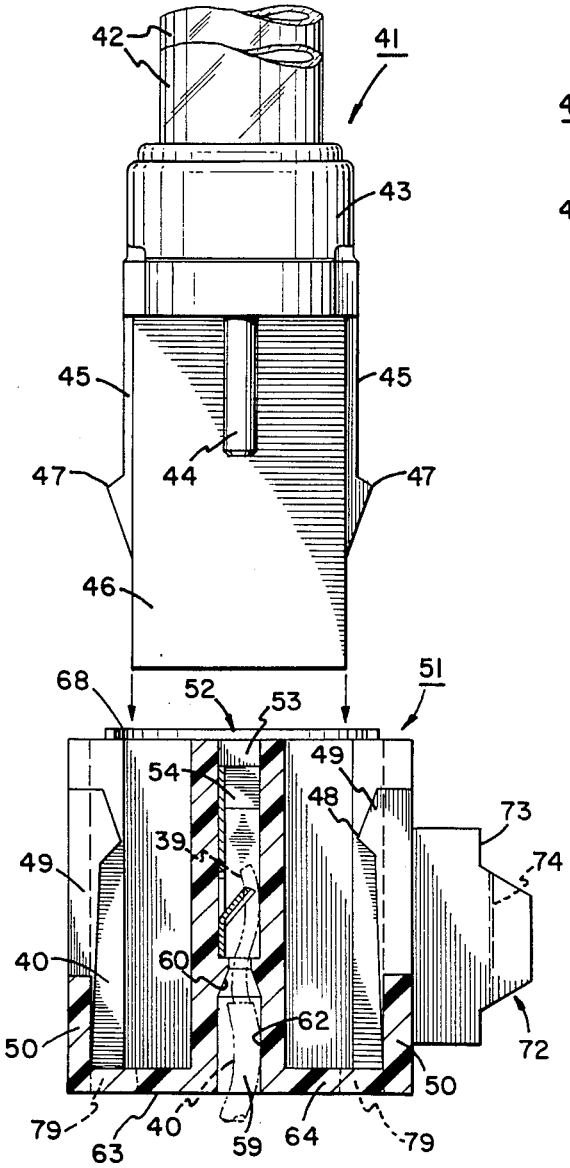
FIG. 2
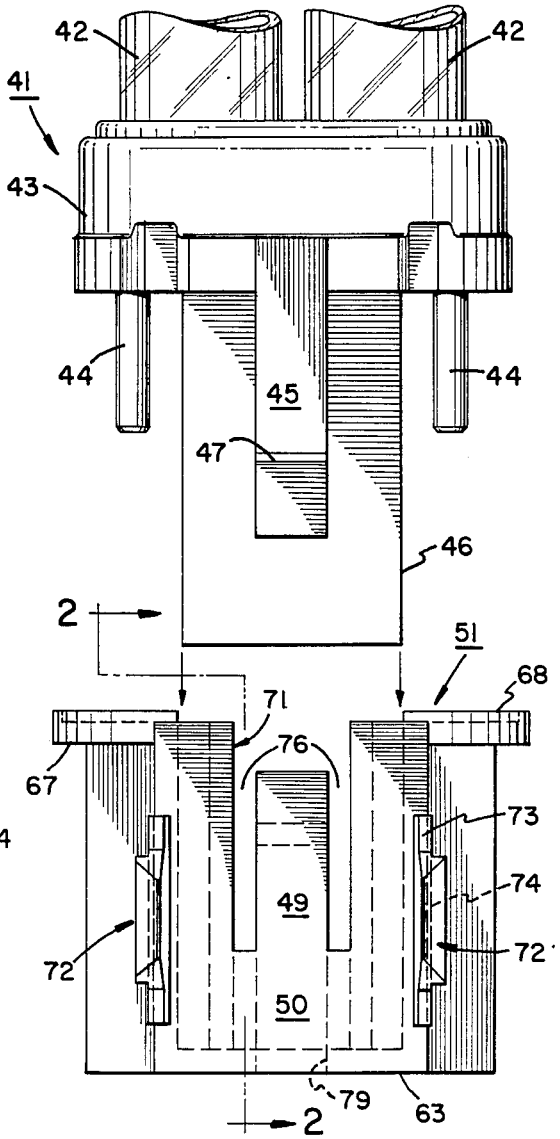
FIG. 3

FIG. 10
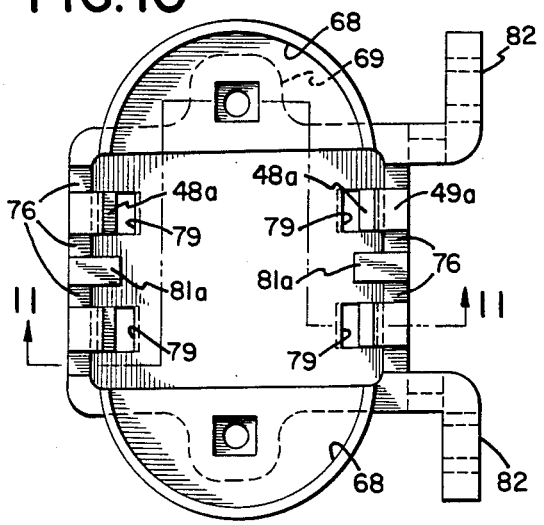
FIG. 12
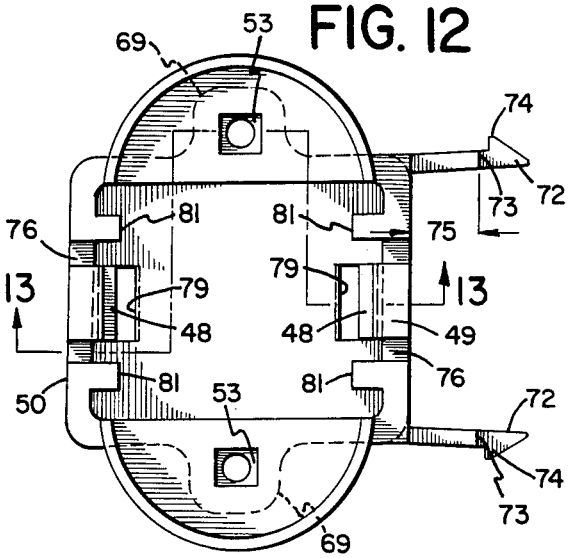
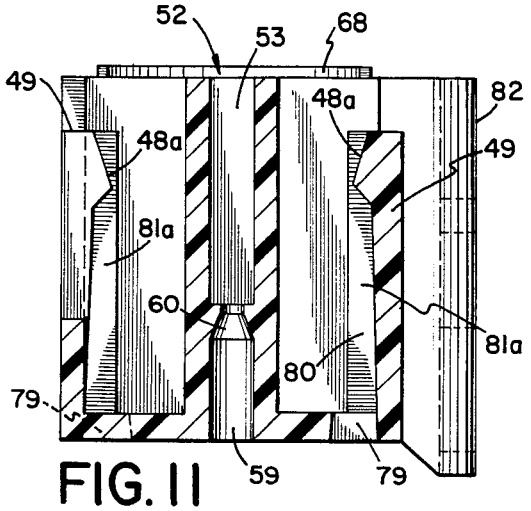
FIG. 11
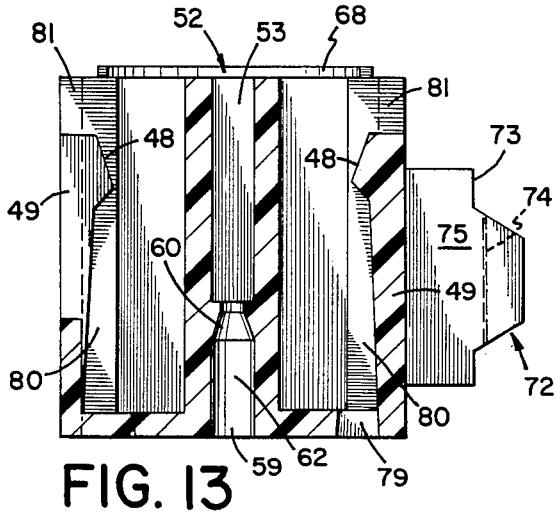
FIG. 13
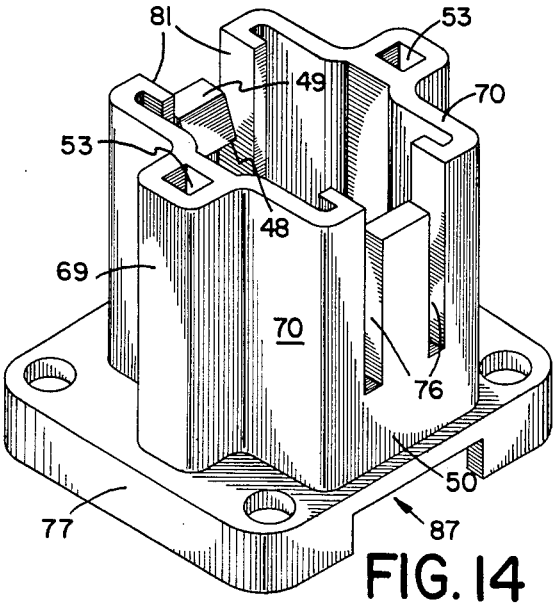
FIG. 14
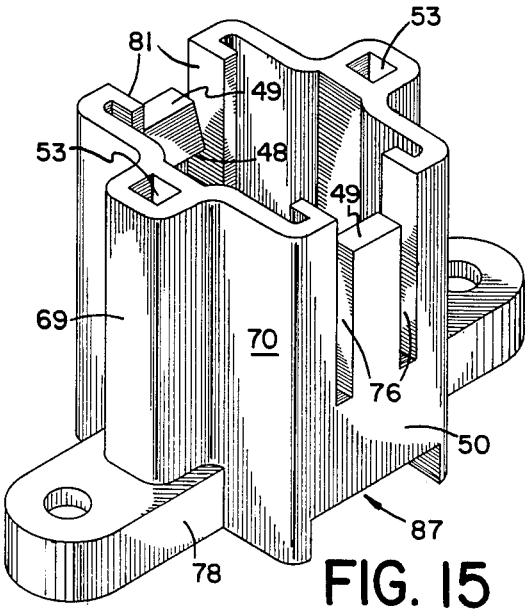
FIG. 15

FIG. 25
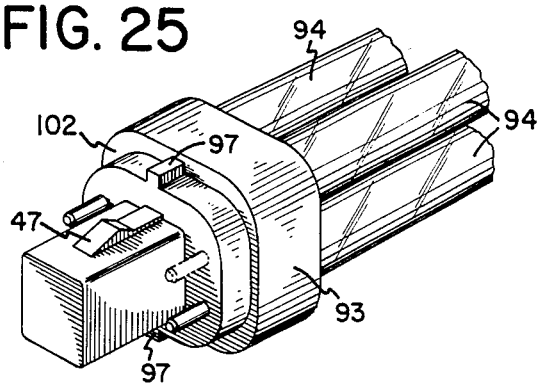
FIG. 20
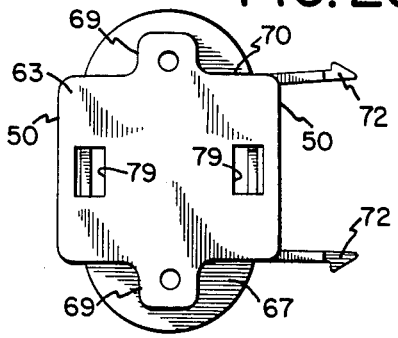
FIG. 26
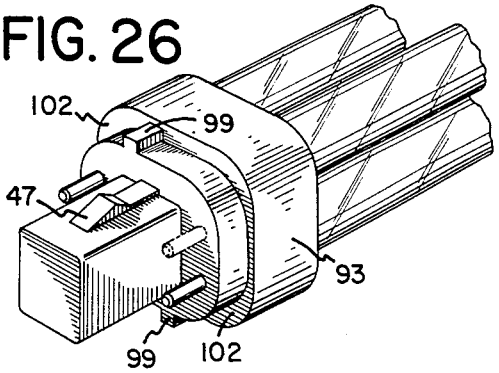
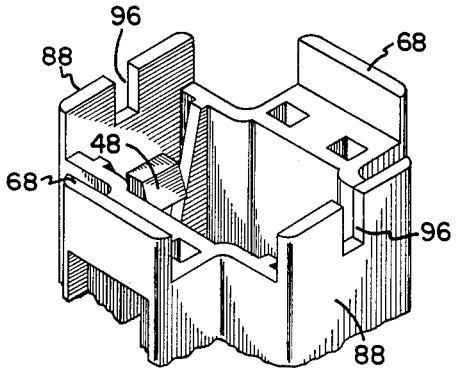
FIG. 29
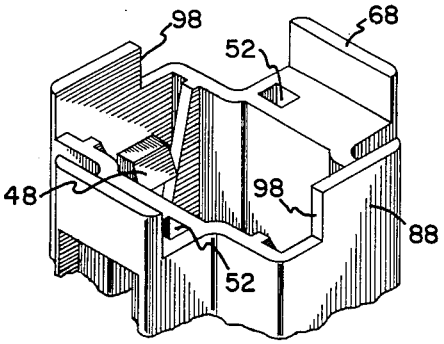
FIG. 27
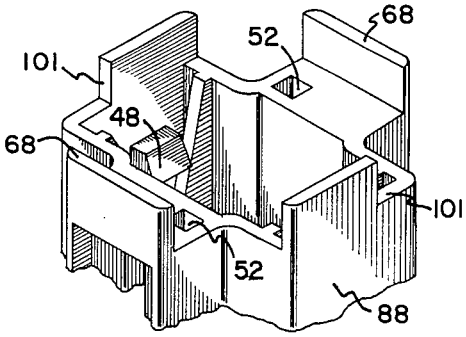
FIG. 30
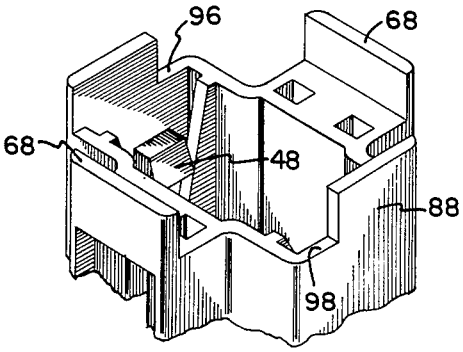
FIG. 28
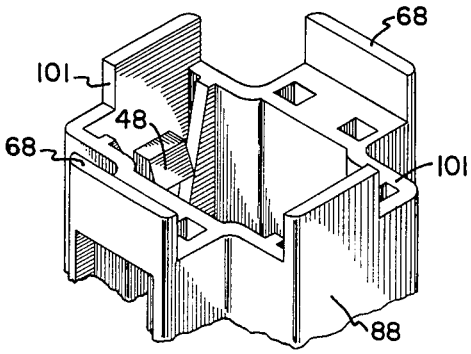
FIG. 31

SOCKETS FOR COMPACT FLUORESCENT LAMPS

BACKGROUND OF THE INVENTION

1. Field of the Invention

The present invention relates to electrical sockets and connectors in general, and more particularly to a female holder or socket for a compact fluorescent lamp having two or more compact fluorescent tubes which share a common base, wherein the socket provides electrical connections and gripping means for the lamp base.

2. Description of the Related Art

Compact, super compact or "Mini-" fluorescent lamps, known by many commercial names, such as Philips "PL" and "PLC", OSRAM "DULUX S", "DULUX D" and "DULUX E", Sylvania "Twin Tube" and "DBL Twin Tube" and GE "Mod-U-Line", are rapidly gaining in popularity because they often provide as much light as a similar size incandescent lamp while requiring less than one-third the power and achieving 10 times greater service life.

These compact fluorescent lamps require a range of sockets of unique design, in order to provide advantages to the user which may include various mounting methods to a surface, keying to accept lamps of correct wattage and rapid, safe and easy wiring. Employing all the advantages are important with this type of lamp, because with all connections made at a single base rather than at opposite ends of the common fluorescent tube, compact fluorescent lamps are finding application in space-saving lighting fixtures, ergonometric desk lamps, explosion-proof globes and other single-end access fixtures formerly requiring incandescent lamps.

In order to provide a wide range of sockets in large quantity and at low cost to meet expected demand, need for improvement in socket design for efficient, low cost manufacture has become apparent.

Presently, a socket for a compact fluorescent lamp is typically assembled in several steps from five or more molded plastic and stamped metal component parts. Furthermore, the metal elements are fabricated from two different kinds of metal stock. The plastic elements, which slide one within the other during assembly, must be molded to close tolerances, closer than are required for an adequate fit between socket and lamp base in actual use.

One example of this socket design is an Edwin Gaynor Company socket designed for seven and nine watt compact fluorescent lamps. The socket includes a housing enclosure, open at one end to accept a U-shaped insert having on a first pair of opposite sides, recessed upstanding terminal-embracing posts. The housing enclosure is molded in one piece with inboard vertical slots to accept the posts in a close sliding fit. The insert is also molded in one piece with the same precision and also includes, within the posts, multicontoured recesses to receive and hold a copper or phosphor bronze terminal strip pressed sideways into each post at its upper portion, and a tapered opening at its bottom to permit quick wire access to the terminal strip. A U-shaped clip which is stamped and formed from resilient steel, embraces the bottom of the insert and extends upward, around it, on the second pair of opposite sides. During manufacture, the terminals are pressed into the posts, the clip is forced over the bottom of the insert and the resulting sub-assembly is oriented and inserted slidingly down into the housing enclosure.

In another example, as described in U.S. Pat. No. 4,596,433 for a LAMPHOLDER HAVING INTERNAL COOLING PASSAGES, issued June 24, 1986 to Klaus Oesterheld et al, the four-part socket assembly includes a housing open at one end whereby a resilient steel U-shaped clip is pressed in from the front and is held grippingly in the housing by outwardly and upwardly directed stamped fingers which bear against the inner surface of the housing walls on opposite sides. At the bottom of the housing there are two openings for the stamped and shaped terminals which are pressed directly into the housing on each side, from the bottom.

SUMMARY OF THE INVENTION

The lamp holder sockets of the present invention each employ only a single molded plastic housing, shaped and contoured for resilient gripping of compact fluorescent lamp bases without steel gripping springs.

Briefly, according to the invention, there is provided a socket for compact fluorescent lamps having two or more parallel fluorescent tubes sharing a common base that has two or more terminal pins. The lamp base includes retaining hook or flange means and often has keyed protrusions to differentiate one wattage level lamp from another.

The socket comprises a housing which includes four joined side walls and a back wall. A front end opening is provided to receive the lamp base. At least one wall includes an integral resilient flange having an inward facing hook shaped for establishing reversible gripping engagement with a retaining hook on the base of the lamp when the lamp base is inserted into the housing.

Below the inward facing hook and located in the back wall, is an opening that is at least equal to a profile or projection of the hook as viewed from the back of the socket. This opening provides access to the lower portion of the hook in order to manufacture it as a unitary part of the socket.

Channels embracing metal terminals for receiving the lamp's pins at one end and connecting wires at the other end are defined within two opposed walls of the housing. Extending from the front to the back of the socket, each channel has a constricted portion near the back. The terminal, occupying most of the channel forward of the constriction, is formed in the shape of a trough, dimensioned at its front so that at least two inner surfaces of its walls contact the received pin for establishing electrical contact. Its back end includes a wire-grip flange comprising a portion of one wall bent toward an opposed wall so that the V resulting will accept a wire's entrance into it and through the vertex but will resist its withdrawal.

Lips or rims are provided at the top of the socket to protect the lamp pins from contact by foreign bodies when the lamp base is installed in the socket.

Inward directed extensions on the walls resist cocking of the lamp base seated in the socket and, with contoured walls, permit circulation of air from the back wall slot over substantial surfaces of the lamp base which are adjacent to the side walls when the lamp base is seated in the housing.

If desired, a pair of outer side walls, parallel to two of the aforedescribed walls include keying to accept the lamp's keyed protrusions.

In one embodiment, the socket includes a pair of snap-in-lock flanges joined to a side wall of the socket for holding it spaced from a mounting surface.

In another embodiment, the housing includes a base mount flange.

In another embodiment, the housing includes snap-in-lock assemblies for mounting the socket through the mounting surface.

In another embodiment, the housing includes provision for snap-in-lock base mounting.

Accordingly, a principal object of the invention is to reduce the overall cost of manufacture of sockets for compact fluorescent lamps.

Another object of the invention is to reduce the number of parts necessary for construction of the socket.

A further object of the invention is to reduce the number of assembly steps required for manufacture of the socket.

Another object is to reduce the number of components fabricated from different materials needed to manufacture the socket.

Yet another object of the invention is to reduce the tolerance requirements in manufacture and assembly of the socket without reducing the quality and efficiency of its intended performance.

Still another object of the invention is to provide a standard basic socket which lends itself to easy and quick acceptance of mounting style changeover in manufacture, by utilizing various molding dies producing different shapes and orientations of mounting flanges.

Another object of the invention is to provide a socket affording easy and quick access for wire connections.

Still another object is to provide sufficient access space for insulated wires to permit orientation of their stripped ends for connection without damage to the insulation or shorting to a mounting surface.

It is still another object of the invention to provide air circulation for removal of heat generated by the lamp.

Other objects of the invention will in part be obvious and will in part appear hereinafter.

The invention accordingly comprises the features of construction, combinations of elements, and arrangements of part which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

BRIEF DESCRIPTION OF THE DRAWINGS

FIG. 1 is a perspective view of a 7-watt, twin tube compact lamp;

FIG. 2 is a side elevation view of a 7-watt compact lamp base ready for insertion into a snap-in-lock type side mount socket of the invention, shown in cross-section;

FIG. 3 is a front elevation view of the same 7-watt compact lamp base prior to insertion into the same snap-in-lock type side mount socket of the invention, with the snap-in-lock flanges extending toward the viewer;

FIG. 10 is a top plan view of the socket shown in FIG. 9;

FIG. 11 is a cross-sectional side elevation view of the socket of FIGS. 9 and 10;

FIG. 12 is a top plan view of the socket shown in FIG. 4;

FIG. 13 is a cross-sectional side elevation view of the socket of FIGS. 4 and 12;

FIG. 14 is a perspective view of a four-hole base mount socket according to the invention, for 7–9 watt compact lamps;

FIG. 15 is a perspective view of a two-hole base mount socket according to the invention, for 7–9 watt compact lamps;

FIG. 20 is a bottom plan view of the socket shown in FIGS. 4, 12 and 13;

FIGS. 25 and 26 are fragmentary perspective views of the base portions of two different forms of super compact lamps having dual-pin "G24d" bases or quad-pin "G24q" bases, showing their different key protrusions; and FIGS. 27, 28, 29, 30 and 31 are fragmentary perspective views of various modified forms of sockets of the present invention, showing different contact pin and key protrusion configurations designed to receive different versions of OSRAM "DULUX D" Lamps.

DETAILED DESCRIPTION OF THE PREFERRED EMBODIMENTS

Figure 4:
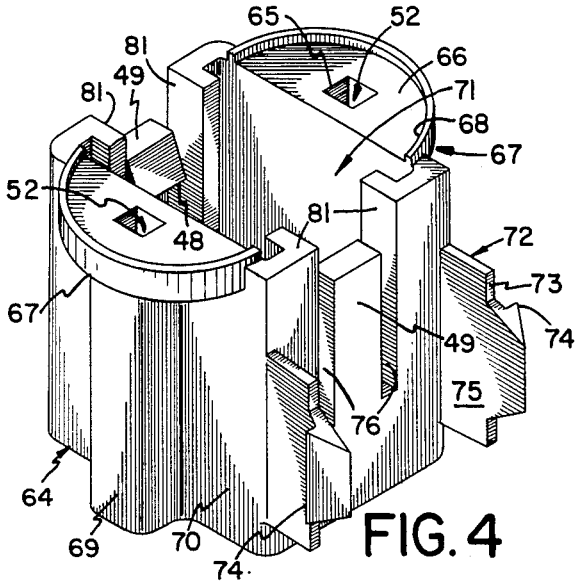
FIGS. 4, 5, 6, 7, 8 and 9 are corresponding perspective views of different variations of the sockets of the present invention.

Referring now to the drawings, FIG. 1 shows a compact fluorescent lamp 41, such as the Philips "PL", OSRAM "DULUX S", Sylvania "Twin Tube" or GE "Mod-U-Line" ® which are engageable in the molded plastic sockets of the invention, such as the socket 51 shown in FIGS. 2 and 3. The lamp 41 includes two parallel tubes 42 which are connected to each other so that operating in series, they provide the service of a tube equal to the sum of their lengths. The tubes terminate in a common base 43 which includes male terminal pins 44, as shown in FIGS. 1, 2 and 3. The base also includes a pair of ribs 45 formed on a molded plastic base block 46, extending down from and parallel to the tubes 42 and having a ramped triangular retaining hook 47 molded therein for holding the base in an appropriately designed socket.

Hook 47 resiliently engages with a molded plastic hook 48 on a resilient flange 49, formed as a part of wall 50 of socket 51. Molded hook 48 is shaped so that when the lamp base is inserted in the socket, the ramped portions of the hooks 47 and 48 automatically force flanges 49 outward, and block 46 moves down into a fully seated position once the vertexes of the hooks 47 and 48 pass each other. This also provides an audible and tactile "click" when so operating, confirming seated installation of the lamp in its socket without appreciable scratching or wear to either hook over repeated use. These desirable operating features are provided by hook 48 on resilient flange 49 without extra cost in assembly or steps in manufacture, by being integrally molded as part of body wall 50 of molded plastic socket 51.

Figure 24:
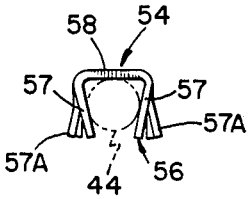

A front portion 53, of a front-to-back channel 52 formed in socket 51, as illustrated in FIG. 2, is designed to accept a stamped and formed resilient metal terminal 54, shown in FIGS. 2 and 21–24. Terminal 54 is formed in a squared off U-shaped at its back end 55 (FIG. 23), and the walls 57 of the U are bent slanting inwardly at the terminal's front end 56 (FIG. 24). About one-quarter to one-third of the way forward from the back end, a U-shaped cut is punched in front wall 58 of terminal 54, and bent slanting inwardly toward the front end of the terminal, forming a wire-grip flange 61. The outer dimension of terminal 54 is approximately equal to the inner dimension of square portion 53 of channel 52. Slit flared flanges 57A in side walls 57 anchor terminal 54 in channel 52.

The reduced dimension of front end 56 (FIG. 23) is dimensioned to receive lamp pin 44. Once the terminal 54 is installed, its back end 55 serves as a quick wire grip 58 to accept tinned stranded or solid conductor wire 39 by mere endwise insertion through the back end opening 59 of channel 51, and a peripheral constriction 60, centrally molded in the channel 52 provides a guide for the wire into the terminal.

Wire-grip flange 61 holds an inserted wire 39 firmly, preventing unintentional withdrawal. Back-end opening 59 includes an insulation-accepting tunnel 62 which accommodates a buffer of wire insulation 40 between the stripped end portion of wire 39 that is locked into terminal 54 by wire-grip flange 61, and the outer surface 63 of the back wall 64 of the socket. Terminal 54, when fully installed in square portion 53, does not protrude above the opening 65 in front face 66 of top platform 67 of the socket (FIG. 4). A raised lip 68 extends above opening 65 and the interface formed at front face 66 when the lamp base 43 is installed in the socket 51, thus preventing accidental contact of wires, knife blades or other foreign bodies with the lamp base pins 44.

Since terminal 54 is square in cross-section, its angular orientation about its long axis in channel 52 is not critical, as long as the front end 56 of terminal 54 faces the front end of socket 51 to receive pins 44 of lamp 41, and the back end 55 of terminal 54 faces the constriction 60 to receive bared wire 39 thrust through tunnel 62.

The extremely simple design of the terminals 54 permits them to be installed in channels 52 by automatic assembly machines.

Although assembly by insertion has been discussed, it is within the contemplation of the invention to include the terminals in the socket during the molding process, or to anchor the terminals by ultrasonic insertion with interference fit. It is also within the contemplation of the invention to seal over a portion of opening 65 after insertion of the terminal to prevent its withdrawal by higher than normal-use forces.

Turning to the socket 51 in further detail, by reference to FIGS. 4, 12, 13 and 20, the channel 52 is located in a rib 69, located outside opposed walls 70 which, in combination with opposed walls 50 and backwall 64, comprise the housing 71 of the socket. Snap-in-lock flanges 72 permit mounting the socket with its side wall 50 adjacent to a mounting surface (not shown). Shoulder 73 on the flange 72 and its hook 74 are spaced to grip the facing and rearward faces respectively of the mounting surface in order to hold the socket firmly in place, at a distance from the mounting surface that is equal to flange portion 75 (FIG. 12) between the shoulder 73 and wall 50.

Heat generated by the lamp incorporating base 43 and base block 46 is removed by convection of air which flows through spaces 76 formed between resilient flange 49 and wall 50 from which it is formed. Additional convection is provided by back-wall slots 79, FIGS. 20 and 13, whereby air which flows through the slots circulates over the surface of base block 46, including those surfaces immediately above the slots where space 80 is allowed for flange flexure (FIGS. 11 and 13). Contouring of the socket walls further aids in permitting air circulation, utilizing such means as walls 70 and inwardly protruding ribs 81 of wall 50, which in conjunction with front face 66 also resist cocking of the lamp base 43 seated in the socket 51 when the lamp receives external forces transverse to walls 50.

Figure 5:
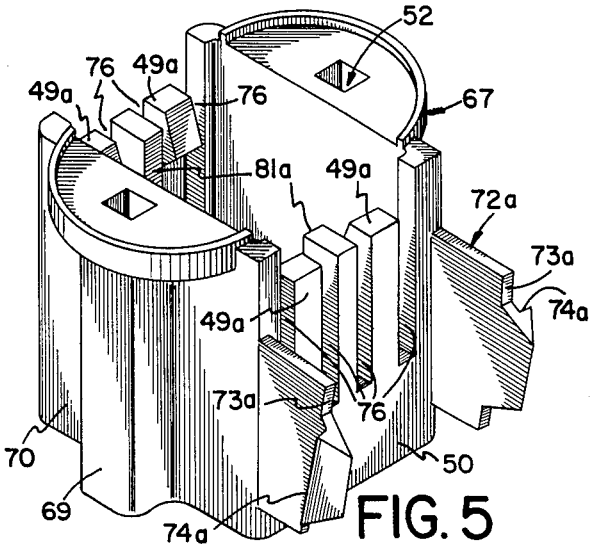
Figure 9:
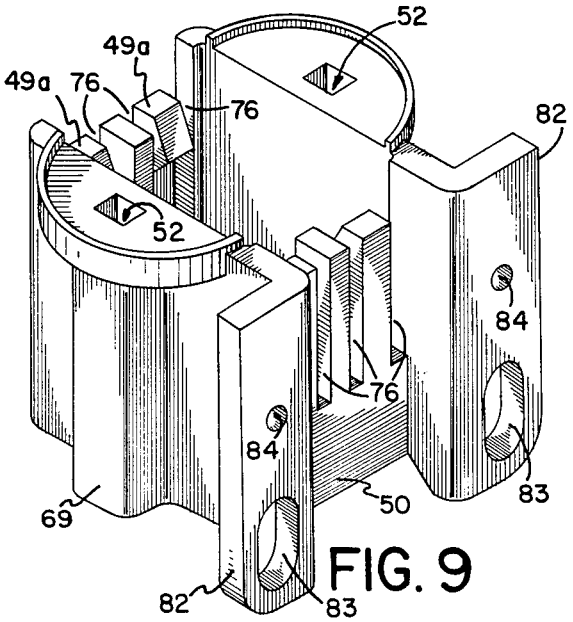
Figure 18:
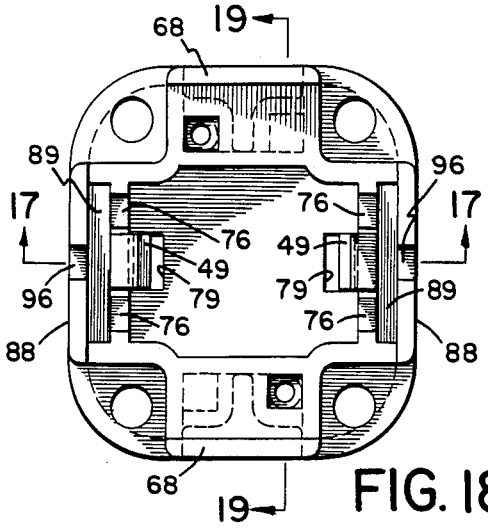
FIGS. 16, 17, 18 and 19 are respectively perspective, front, top and side views of a four-hole base mount socket exemplifying a modified embodiment of the invention, for 10 and 13 watt compact lamps having two diagonally-located electrical contact pins, with FIGS. 17 and 19 being shown in cross-section.
Figure 19:
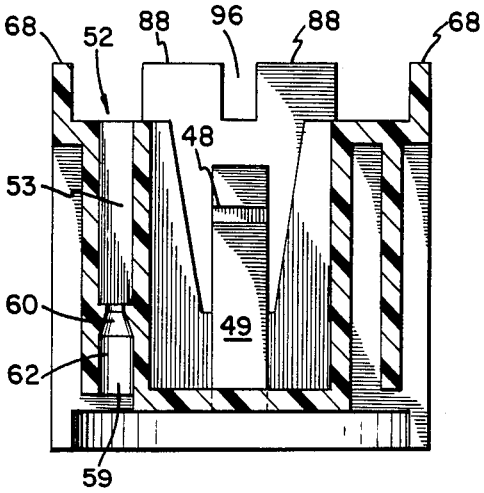
Figure 17:
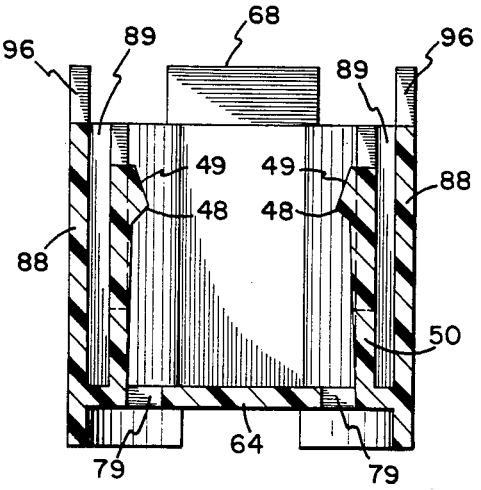
Figure 16:
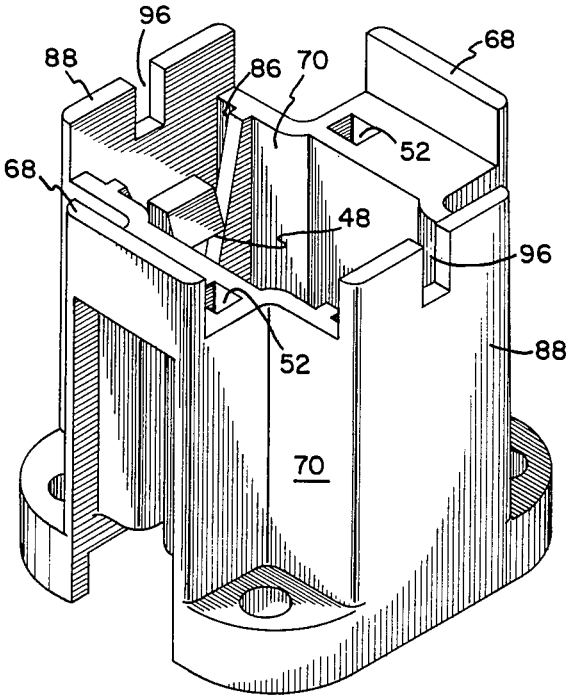
Figure 21:
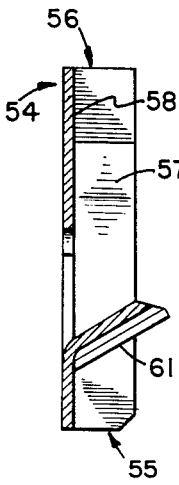
FIGS. 21, 22, 23 and 24 are respectively side, rear, bottom and top views of a conductive terminal for a socket according to the invention, FIG. 21 being a cross-section.
Figure 22:
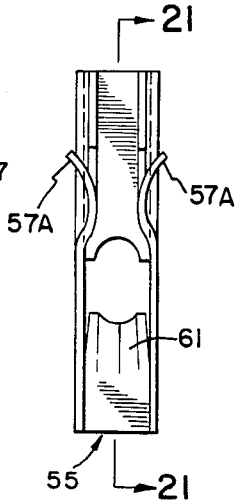
Figure 23:
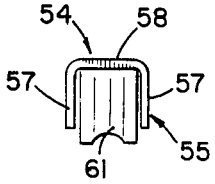

In the modified embodiment shown in FIG. 5, the shoulders **73*a* and hooks 74*a* of the snap-in-lock flanges 72*a* are slanted at an angle of about fifteen degrees from the vertical, for example. This allows the lamp 41 mounted in the socket of FIG. 5 to lean angularly outward away from the mounting surface, for better distribution of illumination or enhanced air circulation around the lamp. Also shown in FIG. 5 are two pairs of resilient flanges 49*a* formed in each sidewall 50 of the socket, accommodating a different lamp base having two pairs of hooked ribs 45. A central rib 81*a* defines with flanges 49*a* four spaces 76 in each sidewall 50. A similar four-flange socket configuration is shown in FIG. 9 and FIG. 10**.

Figure 6:
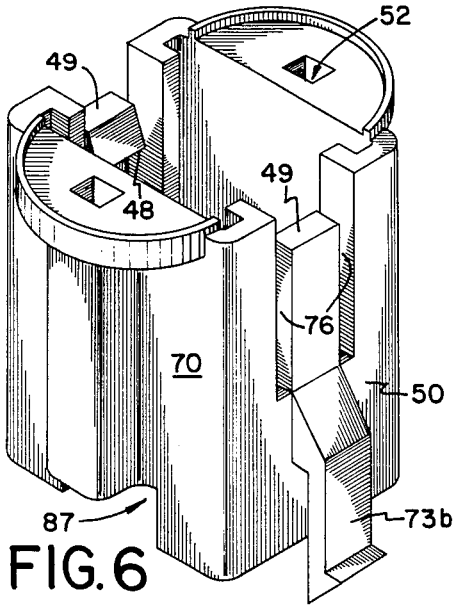

Another modified version of the sockets of this invention is shown in FIG. 6, with downwardly protruding mounting flanges **73*b* extending below backwall 64 from both sidewalls 50**.

Figure 7:
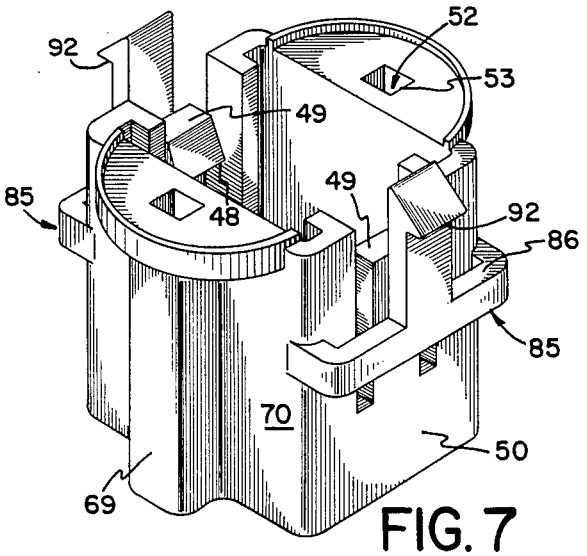

Another embodiment of the socket is shown in FIG. 7, with an upwardly extending snap-in-lock type top mount flange assembly 85, extending upward from each sidewall 50, instead of side-mount flanges 72. Shoulder 86 of each assembly 85 bears against the underside of the mounting surface (not shown) while the hooks 92 bear on the top of the mounting surface.

Figure 8:
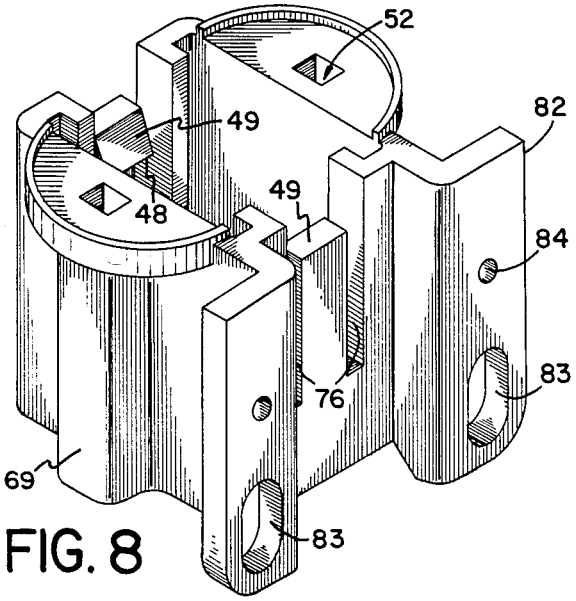

In another embodiment, shown in FIG. 8, a similar socket with a single pair of resilient hooked flanges 49 is provided with two-hole side mount flanges 82, instead of the aforedescribed mounts. An elongated hole 83 allows for easy fastener alignment when use of the locating holes 84 over pins is desired. Similar side mount flanges 82 are shown in FIGS. 9, 10 and 11, with two pairs of resilient flanges **49*a***.

In still another embodiment of the invention, a socket having the features of those described earlier is shown in FIG. 14, and another is seen in FIG. 15. They differ from those above in that they respectively incorporate four-hole and two-hole base mount flanges 77 and 78. Wire and air circulation access openings 87 are provided in flanges 77 and 78 to provide access to back-end wire openings 59 and slots 79.

Slot 79, which is at least as large as a profile or projection of retaining hook 48 as taken from below it, permits access to the angled bottom of the hook during molding so that the socket may be molded with the hook as a unitary element. Furthermore, with only a few basic socket configurations, having external mounting flange elements as described, production changeovers from one mounting style to another is easily accomplished by substituting different mold inserts.

Yet another embodiment of this invention is shown in FIGS. 16, 17, 18 and 19; this is a socket for receiving a four-pin lamp base of a diagonally-oriented two-pin lamp base for higher wattage compact lamps, typically in the 10 to 26 watt range. Lamps such as the Philips "PLC", the OSRAM "DULUX D" and "DULUX E" and the Sylvania "DBL Twin Tube", with a round-cornered rectangular base 93 and a pair of U-shaped tubes 94 shown in FIGS. 25 and 26 are accommodated by these sockets of FIGS. 16–19 and 25–31. Resilient flanges 49 are formed from wall 50 as described earlier, flanked by air spaces 76. An additional outer side wall 88 is provided, spaced outward by space 89 from each sidewall 50, allowing for outward flexure of resilient flange 49. The top of outer wall 88 is keyed to accept only the keyed protrusion of the correct wattage lamp for the socket shown. During the molding process, inserts may be included in the molding die to block or provide a clear channel 52 as desired.

Thus in FIGS. 16–19 and 29, a central key slot 96 is formed to receive the central key protrusions 97 formed in base 93 of the OSRAM "DULUX D" or "DULUX E", the Philips "PLC" or the Sylvania "DBL Twin Tube" minifluorescent lamp shown in FIG. 25.

In the sockets of FIGS. 27 and 28, a left notch key slot 98 is formed in the top corners of each outer wall 88, to receive the left-offset key protrusions 99 in the different "DULUX D" Lamp shown in FIG. 26.

Opposite, right notch key slots 101 are formed in the top corners of each outer wall 88 in the sockets shown in FIGS. 30 and 31, to receive right-offset key protrusions of a still different lamp base not shown in the drawings.

All of the key protrusions 97 and 99 extend downward from an overlying shelf 102 of lamp base 93, shown in FIGS. 25 and 26. Shelf 102 descends into abutting engagement with the upper edges of the sidewalls 88 and the raised lips 68 forming the rim of the "DULUX D" bulb sockets, stabilizing the bulbs latched therein by the resilient engagement of their retaining hooks 47 with the mating hooks 48 formed on resilient flanges 49.

Various lamp connector pin orientations may be combined with the key protrusion positions to distinguish different lamp sizes, types and wattages. Thus, the sockets shown in FIGS. 16, 18, 19, 27 and 30 accommodate lamp connector pins 44 offset to the right in right-offset channels 52. The sockets shown in FIGS. 28, 29 and 31 incorporate four channels to receive a four-pin lamp base.

Right-offset channels to receive a lamp base having right-offset pins (not shown in the drawings) are readily formed by slight changes in inserts in the socket molding dies.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A socket for a compact fluorescent lamp which includes two or more parallel tubes that share a common base, said base including at least two terminal pins and at least one laterally extending retaining hook, said socket having an open front lamp-receiving recess and a back end, and further comprising:

a housing having a back wall, with first, second, third and fourth joined side walls, each joined at one end to the back wall, said side walls defining a front opening at their other front end for receiving the lamp base, said first and third walls and said second and fourth walls being in opposition to one another, and defining with said back wall the lamp-receiving recess, a portion of said first wall comprising an integral resilient flange having an inward facing hook, shaped and aligned for establishing reversible locking engagement with said base retaining hook when the lamp base is inserted into the housing recess, and channel means formed in said housing enclosing conductive terminal means for receiving each of said terminal pins in electrically conductive engagement.

2. The socket defined in claim 1, wherein said first and third opposed socket side walls are each formed with one said integral resilient flange therein for reversible locking engagement with base retaining hooks on opposed sides of the common lamp base.

3. The socket defined in claim 1, wherein said first and third opposed socket side walls are each formed with a plurality of said integral resilient flanges therein for reversible locking engagement with a corresponding plurality of base retaining hooks on said common lamp base.

4. The socket defined in claim 1, wherein said integral resilient flange is flanked by open slots providing spaced for ventilating air circulation past said common lamp base.

5. The socket defined in claim 1, further including means forming an aperture through said housing back wall directly behind the inward facing hook of said integral resilient flange, whereby the socket housing is adapted for fabrication as a one-piece plastic molding while vents are also provided to admit air for ventilating circulation past the common lamp base.

6. The socket defined in claim 1, further including lip means, extending from said second and fourth walls above said front opening of the housing recess, and blocking contact between foreign bodies and the pins when the lamp base is installed in the socket.

7. The socket defined in claim 1, further including a pair of outer side walls external to the housing, parallel with and spaced from the said first and third walls, said pair of outer walls each having an extension protruding forward of the housing recess front opening, and keying means formed in said extensions for engagement with mating key means formed on said lamp base.

8. The socket defined in claim 1, further including a base mound flange joined with said back wall, said flange including an access opening.

9. The socket defined in claim 1, further including a pair of snap-in-lock flanges, joined to and protruding from the socket housing, each flange including a shoulder and a hook for gripping a mounting surface, said shoulder and hook being spaced from the socket housing for holding the socket spaced from the mounting surface.

10. The socket defined in claim 1, comprising a pair of snap-in-lock flanges, joined to opposed side walls and extending backward beyond said back wall for gripping a mounting surface in cooperation with the back wall.

11. The socket defined in claim 1, further comprising a pair of snap-in-lock assemblies, joined to and protruding from the socket housing, each assembly including a shoulder and a hook for gripping different opposed rim portions of a socket mounting aperture formed in said mounting surface, whereby said socket extends through said mounting surface.

12. The socket defined in claim 1, wherein said channel means for receiving said terminal pins includes:

means within said second and fourth walls, defining channels extending from the front end to the back end of the socket, said conductive terminal means being located within the channels for electrically connecting with the pins at the front of the socket, said terminal means being adapted for receiving in electrically conductive engagement a bared wire introduced through the back of the socket.

13. The socket defined in claim 12, wherein said channel includes an intermediate constricted portion spaced from said front opening so that it will not interfere with the pin when the lamp base is fully seated in the socket with the pin inserted in the channel, said conductive terminal means comprises a resilient metal terminal, having three sides formed in the shape of a trough, said trough having a front end for receiving the pin and a back end for receiving a bared wire, wherein said front end of the trough is shaped and dimensioned so that at least two inner surfaces of the trough sides contact the received pin for establishing electrical contact therewith, and a wire-grip flange formed in the trough near its back end, and comprising a portion of one wall of the trough, partially severed therefrom and bent in the form of a concave V slanting toward the front end so that the V will accept a wire advanced convergingly into it and resiliently deflecting its vertex while resisting said wire's withdrawal therefrom, with said trough occupying a substantial portion of that part of the length of the channel that is forward of the intermediate constricted portion.

14. The socket defined in claim 12, wherein said channel includes an intermediate constricted portion apertured to receive a bared wire end inserted therethrough, and said channel also includes a wire insertion portal extending from the back wall to the constricted portion and dimensioned to receive the insulation-covered wire adjacent to the bared wire end inserted through the apertured constricted portion of the channel.

15. The socket defined in claim 1, further comprising a pair of side-mount flanges, joined to a side wall for mounting the socket to a mounting surface.

16. The socket defined in claim 15, further comprising means forming a hole in each flange for locating and an elongated hole for fastening the flange to the mounting surface.

* * * * *